US006867384B1

(12) United States Patent
Ichihara et al.

(10) Patent No.: US 6,867,384 B1
(45) Date of Patent: Mar. 15, 2005

(54) SWITCHING APPARATUS

(75) Inventors: Takashi Ichihara, Kanagawa-ken (JP); Hirohide Okahara, Kanagawa-ken (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 4 days.

(21) Appl. No.: 10/664,393

(22) Filed: Sep. 19, 2003

(51) Int. Cl.[7] ..... H01H 13/70
(52) U.S. Cl. ..... 200/343; 200/517
(58) Field of Search ..... 200/5 A, 5 R, 200/5 E, 296, 341, 343, 329, 517; 400/490, 491, 491.2, 495, 495.1, 496

(56) References Cited

U.S. PATENT DOCUMENTS

| | | | | | |
|---|---|---|---|---|---|
| 3,800,104 | A | * | 3/1974 | Lien et al. | 200/5 A |
| 4,052,579 | A | * | 10/1977 | Arthur | 200/343 |
| 4,435,796 | A | * | 3/1984 | Saito et al. | 368/321 |
| 5,545,866 | A | * | 8/1996 | Bulin et al. | 200/345 |
| 5,990,432 | A | * | 11/1999 | Kuroda | 200/343 |
| 6,169,256 | B1 | * | 1/2001 | Hanahara et al. | 200/5 A |
| 6,201,202 | B1 | * | 3/2001 | Katagiri | 200/513 |
| 6,566,615 | B2 | * | 5/2003 | Takeda | 200/5 B |
| 6,570,111 | B2 | * | 5/2003 | Nakagawa et al. | 200/343 |

FOREIGN PATENT DOCUMENTS

| | | | | | |
|---|---|---|---|---|---|
| JP | 05234464 | A | * | 9/1993 | H01H/21/00 |
| JP | 05234465 | A | * | 9/1993 | H01H/21/00 |

* cited by examiner

*Primary Examiner*—Elvin Enad
*Assistant Examiner*—Lisa Klaus
(74) *Attorney, Agent, or Firm*—Pearne & Gordon LLP

(57) ABSTRACT

Herein disclosed is a switching apparatus, comprising: a rear panel; a front panel fixedly connected with the rear panel and having a holder portion; a switch device including a stationary contact member fixedly mounted on the rear panel, and a movable contact member movable with respect to the stationary contact member to assume two different positions including a switch-on position and a switch-off position; and a push button including a pair of horn projections protruding in opposite directions and each having a center axis. The push button is supported on the front panel with the horn projections frictionally held in the holder portion of the front panel. The push button is adapted to support the movable contact member and pivotable around the center axis of the horn projections together with the movable contact member in two different directions including a button-pushed direction to have the movable contact member move with respect to the stationary contact member toward the switch-on position and a button-released direction to have the movable contact member move with respect to the stationary contact member toward the switch-off position.

20 Claims, 8 Drawing Sheets

2

3

SWITCHING APPARATUS

BACKGROUND OF THE INVENTION

1. Field of the Invention

The present invention relates to a switching apparatus, and more particularly to a switching apparatus for carrying out a switching operation with reduced noises.

2. Description of the Related Art

Up until now, there have been proposed a wide variety of conventional switching apparatuses available for an electric device to be assembled in, for example, an automotive vehicle for the purpose of simple in construction and inexpensive in production cost.

One typical example of the conventional switching apparatus of this type is exemplified and shown in FIG. 8 as comprising a rear panel 600, a front panel 200 fixedly connected with the rear panel 600 and having a groove 220 formed therein; a switch device 500, and a push button 100. The front panel 200 includes a holder portion 210 and a cover plate 300 collectively defining the groove 220.

The switch device 500 has a stationary contact member, not shown in FIG. 8, fixedly mounted on the rear panel 600 and a movable contact member 510 movable with respect to the stationary contact member between a switch-on position where the movable contact member 510 is brought in contact with the stationary contact member to establish electrical connection between the movable contact member 510 and the stationary contact member and a switch-off position where the movable contact member 510 is brought out of contact with the stationary contact member to establish electrical disconnection between the movable contact member 510 and the stationary contact member. The switch device 500 further has a resilient member, not shown in FIG. 8, for resiliently urging the movable contact member 510 to have the movable contact member 510 move with respect to the stationary contact member toward the switch-off position.

The push button 100 has a pushed portion 110 and a flange portion 140 extending radially and outwardly of and integrally formed with the pushed portion 110. The flange portion 140 has a first flange section 140*a* and a second flange section 140*b* opposing to and spaced apart from the first flange section 140*a* across the pushed portion 110. The first flange section 140*a* has a horn projection 120. The horn projection 120 protrudes in one direction and has a center axis. The push button 100 is supported by the front panel 200 with the horn projection 120 loosely received in the groove 220. The push button 100 is pivotable around the center axis of the horn projection 120 in two different directions including a button-pushed direction D1 to have the second flange section 140*b* move the movable contact member 510 with respect to the stationary contact member toward the switch-on position and a button-released direction D2 to have the second flange section 140*b* move the movable contact member 510 with respect to the stationary contact member toward the switch-off position with the aid of the resilient member.

The conventional switching apparatus constructed as previously mentioned, however, encounters a drawback that the second flange section 140*b* tends to collide against the front panel 200 immediately after the movable contact member 510 is moved by the resilient member to the switch-off position because of the fact that the push button 100 is pivoted around the center axis of the horn projection 120, which is loosely received in the groove 220. Furthermore, the push button 100 and the front panel 200 are made of a plastic material and have resonant frequencies in high and/or middle frequency ranges. The fact that the push button 100 and the front panel 200 are made of a plastic material and the push button 100 is loosely received in the groove 220 of the front panel 200 leads to the fact that the collision of the second flange section 140*b* of the push button 100 against the front panel 200 causes the push button 100 and the front panel 200 to be resonantly oscillated in high and/or middle frequency ranges, thereby generating unpleasant noises to operators' ears.

SUMMARY OF THE INVENTION

It is, therefore, an object of the present invention to provide a switching apparatus which is simple in construction and noiseless in operation.

It is another object of the present invention to provide a switching apparatus which can prevent the push button from colliding against the front panel immediately after the movable contact member is moved by the resilient member to the switch-off position.

It is further object of the present invention to provide a switching apparatus which can prevent the push button and the front panel from being resonantly oscillated in high and/or middle frequency ranges in the event that the push button collides against the front panel.

In accordance with a first aspect of the present invention, there is provided a switching apparatus, comprising: a rear panel; a front panel fixedly connected with the rear panel and having a holder portion; a switch device including a stationary contact member fixedly mounted on the rear panel, and a movable contact member movable with respect to the stationary contact member to assume two different positions including a switch-on position where the movable contact member is brought in contact with the stationary contact member to establish electrical connection between the movable contact member and the stationary contact member and a switch-off position where the movable contact member is brought out of contact with the stationary contact member to establish electrical disconnection between the movable contact member and the stationary contact member, and a push button including a pair of horn projections protruding in opposite directions and each having a center axis, the push button being supported on the front panel with the horn projections frictionally held in the holder portion of the front panel, the push button adapted to support the movable contact member and pivotable around the center axis of the horn projections together with the movable contact member in two different directions including a button-pushed direction to have the movable contact member move with respect to the stationary contact member toward the switch-on position and a button-released direction to have the movable contact member move with respect to the stationary contact member toward the switch-off position.

In the aforementioned switching apparatus, each of the horn projections may be in the form of a circular cross-section shape having a diameter, each of the horn projections extending substantially along the center axis, the holder portion may have a bottom plate fixedly supported on the front panel, a first plate and a second plate opposing to and spaced apart from each other across the bottom plate, the first plate and the second plate fixedly supported on the bottom plate, the front panel may further include a cover plate securely mounted on the holder portion to define a closed space having each of the horn projections received therein, the cover plate of the front panel and the bottom plate of the holder portion respectively having inner surfaces, the inner surfaces of the cover plate of the front panel and the bottom plate of the holder portion opposing to and spaced apart from each other at a distance therebetween, and the distance of the inner surfaces of the cover plate of the front panel and the bottom plate of the holder portion may be equal to or less than the diameter of each of the horn projections to have each of the horn projections frictionally held in the holder portion of the front panel.

Furthermore, in the aforementioned switching apparatus, each of the horn projections may have first and second contact portions respectively held in pressing contact with the inner surfaces of the bottom plate of the holder portion and the cover plate of the front panel, and a center plane passing through the diameter of each of the horn projections and perpendicular to the bottom plate of the holder portion, each of the horn projections may be elastically deformable along the center plane, and the first and second contact portions of each of the horn projections may be on the center plane, and spaced apart from and in parallel relationship with each other.

In the aforementioned switching apparatus, the first plate and the second plate of the holder portion may have respective inner surfaces, the inner surfaces of the first plate and the second plate of the holder portion opposing to and spaced apart from each other at a distance therebetween, and the distance of the inner surfaces of the first plate and the second plate of the holder portion may be equal to or greater than the diameter of each of the horn projections. The cover plate of the front panel may be elastically deformable with respect to the center plane of each of the horn projections to have each of the horn projections frictionally held in the holder portion of the front panel.

In accordance with a second aspect of the present invention, there is provided a switching apparatus, in which the first plate and the second plate of the holder portion have respective inner surfaces opposing to and spaced apart from each other at a distance therebetween, and the distance of the inner surfaces of the first and second plates of the holder portion is gradually tapered toward the cover plate in such a manner that the distance close to the cover plate is smaller than the distance remote from the cover plate. The distance of the inner surfaces of the first and second plates of the holder portion at the cover plate may be equal to or less than the diameter of each of the horn projections to have each of the horn projections frictionally held in the holder portion of the front panel. At least one of the first plate and the second plate of the holder portion may be elastically deformable with respect to the bottom plate to have each of the horn projections received in the holder portion of the front panel.

In accordance with a third aspect of the present invention, each of the horn projections may be in the form of a circular cross-section shape having a diameter, each of the horn projections extending substantially along the center axis, the holder portion may have a bottom plate fixedly supported on the front panel, a first plate and a second plate opposing to and spaced apart from each other across the bottom plate, the first plate and the second plate of the holder portion respectively may have first ends fixedly supported on the bottom plate and second ends integrally formed with respective ledges inwardly projected toward each other with respect to the bottom plate, the ledges of the first plate and the second plate have respective inner surfaces opposing to and spaced apart from each other at a distance therebetween, the distance of the inner surfaces of the ledges may be gradually tapered in such a manner that the distance remote from the bottom plate is smaller than the distance close to the bottom plate, and the distance of the inner surfaces of the ledges remotest from the bottom plate is less than the diameter of each of the horn projections.

In the aforementioned switching apparatus, the inner surfaces of the ledges remotest from the bottom plate may be opposing to and spaced apart from the bottom plate at a distance equal to or less than the diameter of each of the horn projections to have each of the horn projections frictionally held in the holder portion of the front panel. At least one of the ledges of the first plate and the second plate may be elastically deformable with respect to the bottom plate to have each of the horn projections received in the holder portion of the front panel.

In the aforementioned switching apparatus may further comprises: at least one subsequent push button disposed in the vicinity of the push button, the subsequent push button including a pair of horn projections protruding in opposite directions and each having a center axis, the subsequent push button being supported on the front panel with the horn projections frictionally held in the holder portion of the front panel and pivotable around the center axis of the horn projections together with a movable contact member in two different directions including a button-pushed direction to have the movable contact member move with respect to a stationary contact member toward a switch-on position and a button-released direction to have the movable contact member move with respect to the stationary contact member toward a switch-off position; and a connecting member for connecting one of the horn projections of the subsequent push button with one of the horn projections of the push button. The connecting member may have a torsional rigidity large enough to withstand a torsional force imparted by the one of the horn projections when the push button is pivoted around the center axis of the horn projections. The aforementioned connecting member may be a connecting rod in the form of a hollow shape having pivotably received therein one of the horn projections. The front panel may have formed therein a groove, having each of the horn projections received therein. Each of the aforementioned horn projections may be in the form of an elliptical cross-section shape.

In accordance with a fourth aspect of the present invention, there is provided a switching apparatus, comprising: a support member having a holder portion; a push button having a rotation shaft rotatably and tightly supported on the holder portion of the support member, and a switching device operative to perform a switching action with the rotation of the push button. The holder portion of the support member may have a pair of wall surfaces held in frictional contact with the rotation shaft of the push button. The holder portion of the support member may be partly constituted by a deformable wall section to ensure that the holder portion is deformed to tightly hold the rotation shaft.

In accordance with a fifth aspect of the present invention, there is provided a switching apparatus, comprising: a support member having a holder portion; a plurality of push buttons each having a rotation shaft rotatably and tightly supported on the holder portion of the support member; the push buttons being connected with a connected member made of a resilient material to ensure that when one of the push buttons is operated, the others of the push buttons is prevented from being operated.

BRIEF DESCRIPTION OF THE DRAWINGS

The features and advantages of a switching apparatus according to the present invention will be more clearly understood from the following description taken in conjunction with the accompanying drawings in which.

DESCRIPTION OF THE EMBODIMENTS

Figure 1:
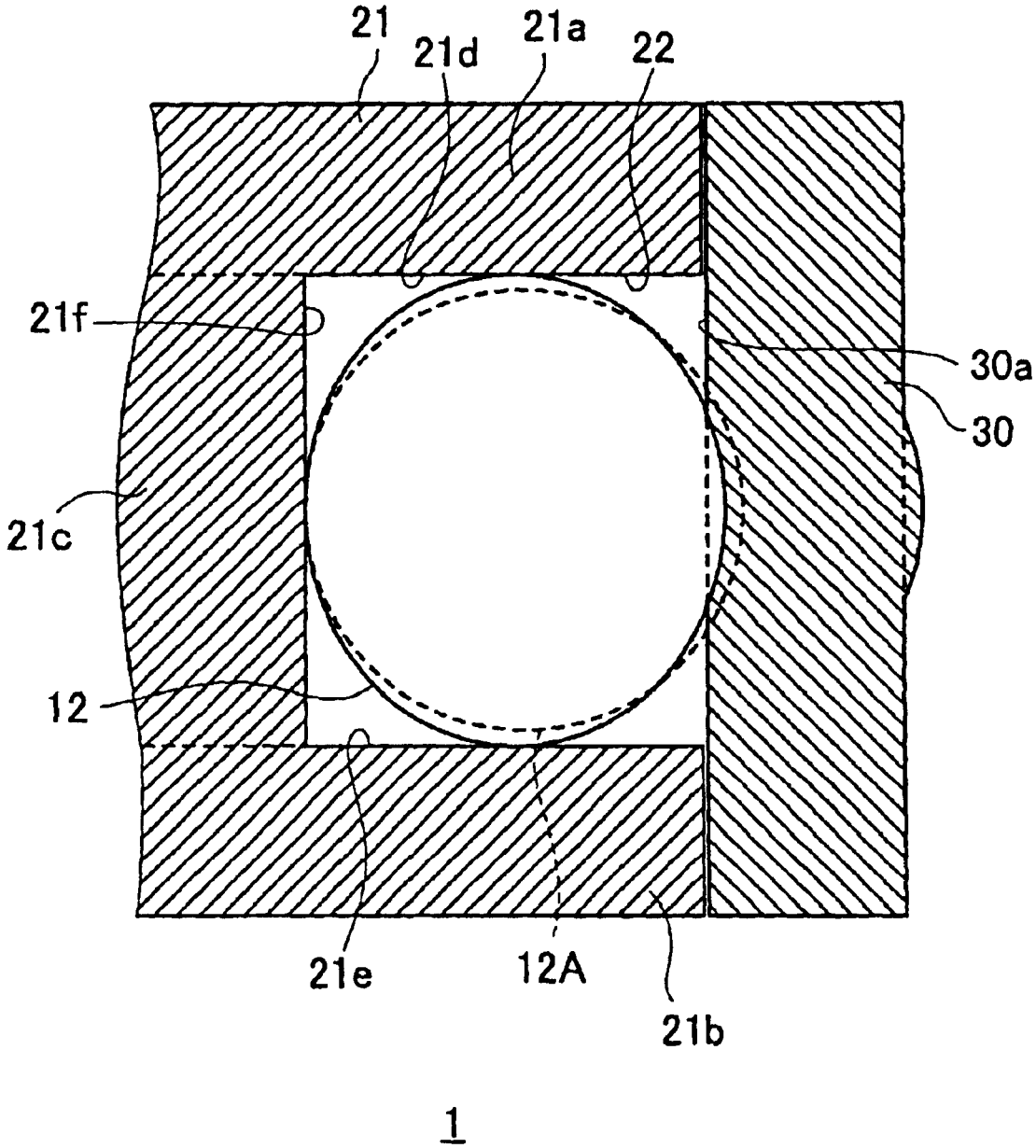
FIG. 1 is an enlarged fragmentary cross-sectional view of a horn projection frictionally held in a holder portion forming part of a first embodiment of a switching apparatus according to the present invention.

Referring now to the drawings, in particular to FIGS. 1 to 7, there is shown the preferred embodiments of the switching apparatus according to the present invention. Throughout the following detailed description, similar reference characters and numbers refer to respective similar elements in all figures of the drawings.

The constitution of the first embodiment of the switching apparatus 1 according to the present invention will firstly be described hereinafter with reference to FIGS. 1 through 4.

Figure 2:
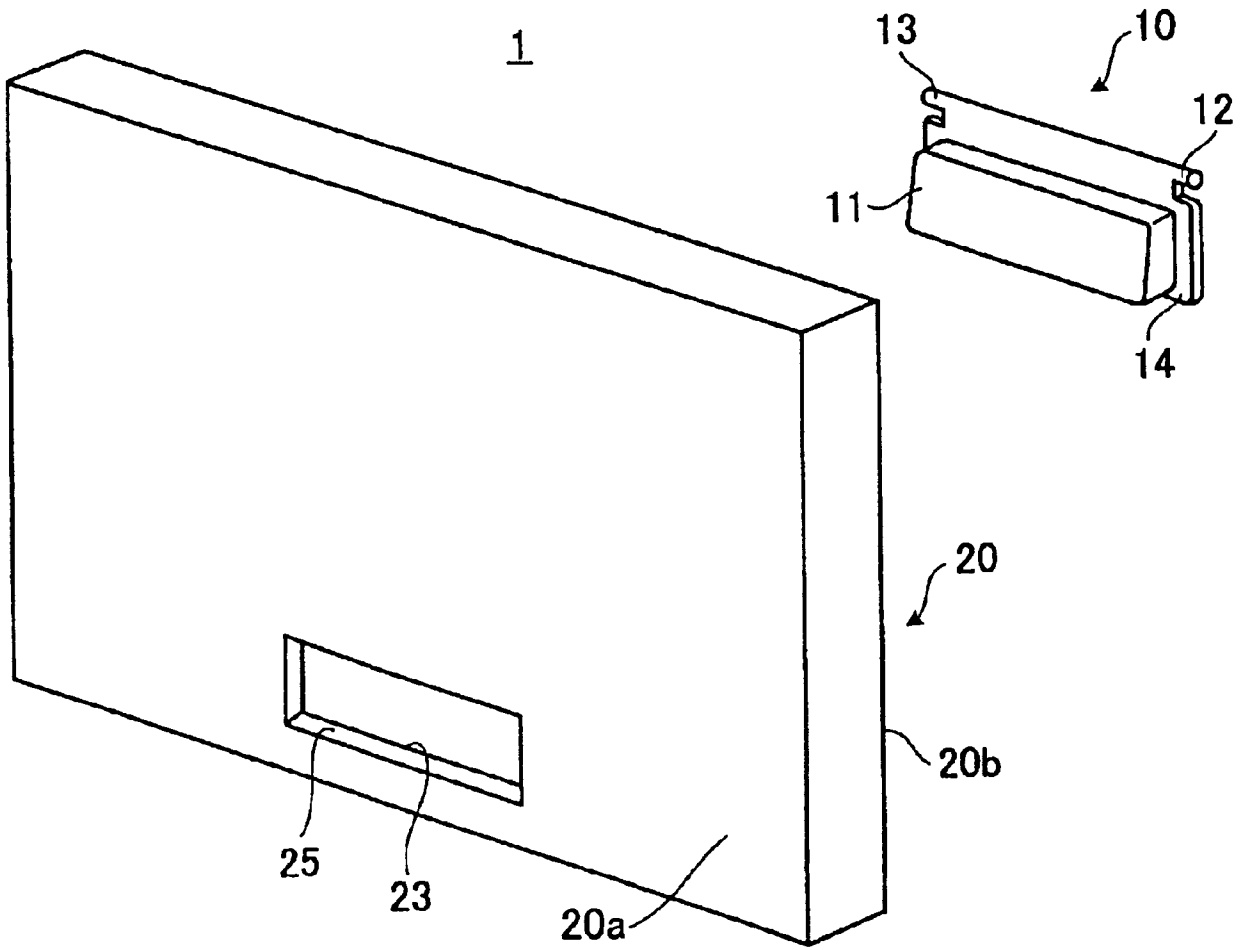
FIG. 2 is an exploded perspective view of the first embodiment of the switching apparatus according to the present invention.
Figure 3:
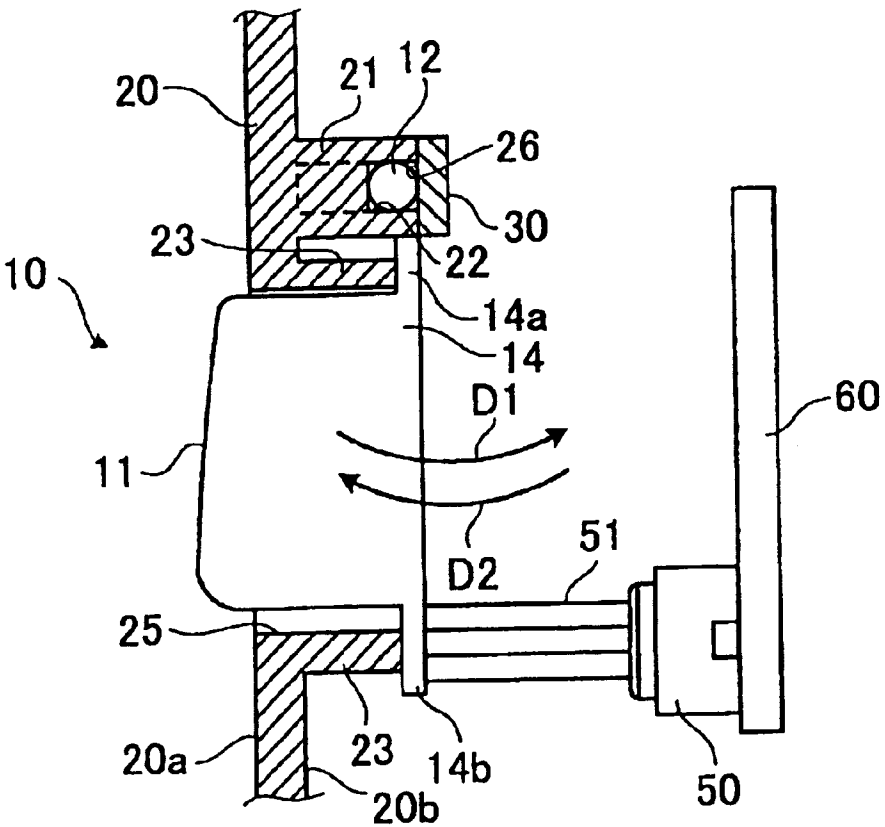
FIG. 3 is a fragmentary cross-sectional side view of the first embodiment of the switching apparatus according to the present invention.

The switching apparatus 1 is shown in FIGS. 2 and 3 as comprising a rear panel 60, a front panel 20, a switch device 50, and a push button 10.

Figure 4:
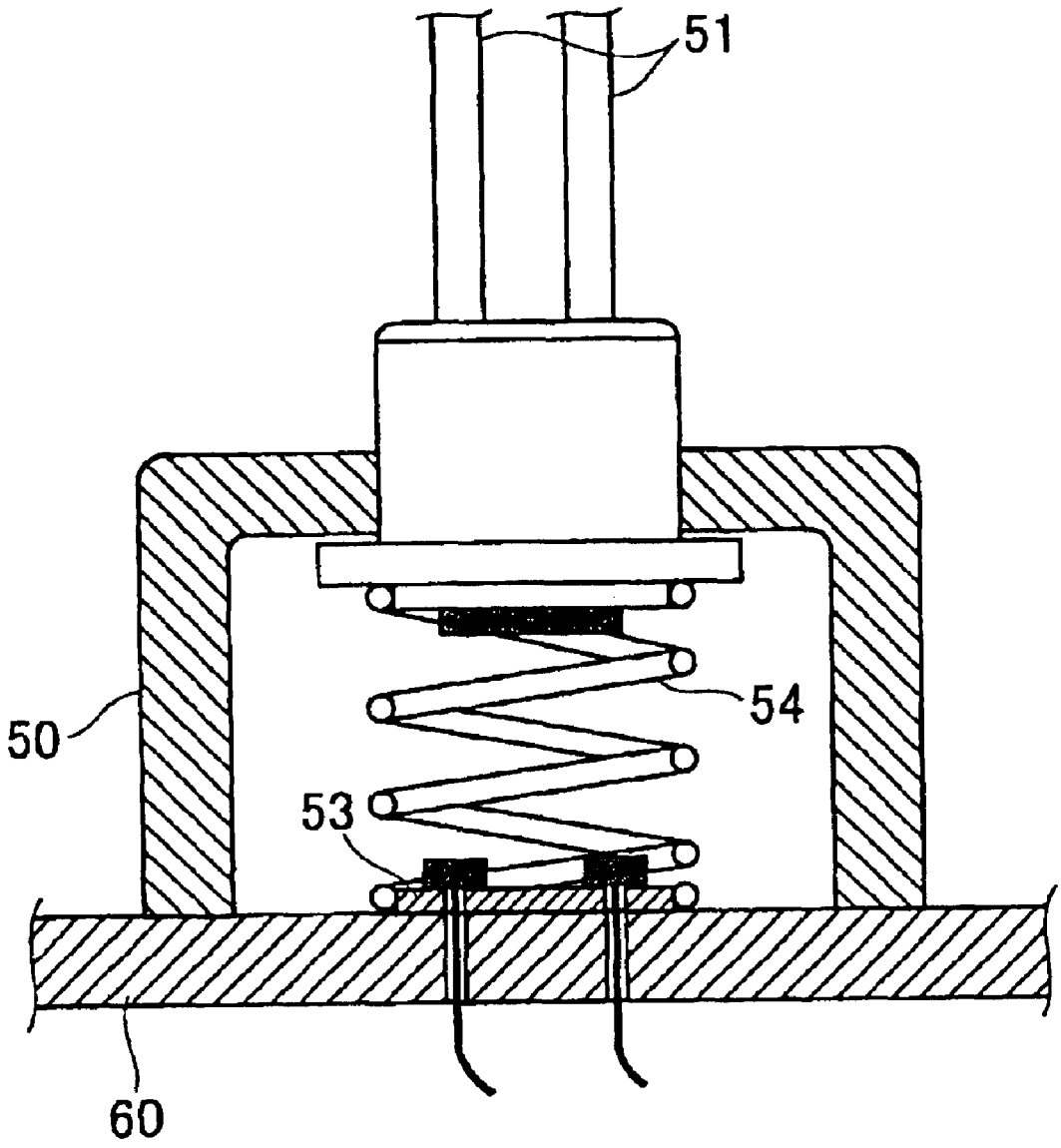
FIG. 4 is an enlarged fragmentary cross-sectional view of a switch device forming part of the switching apparatus according to the present invention.

The front panel 20 is fixedly connected with the rear panel 60 and having a holder portion 21. As best shown in FIG. 4, the switch device 50 includes a stationary contact member 53 fixedly mounted on the rear panel 60, and a movable contact member 51 movable with respect to the stationary contact member 53. In the present embodiment, the movable contact member 51 is constituted by a pair of switch bars. The movable contact member 51 is operative to assume two different positions including a switch-on position where the movable contact member 51 is brought in contact with the stationary contact member 53 to establish electrical connection between the movable contact member 51 and the stationary contact member 53 and a switch-off position where the movable contact member 51 is brought out of contact with the stationary contact member 53 to establish electrical disconnection between the movable contact member 51 and the stationary contact member 53. The switch device 50 further includes a resilient member 54 for resiliently urging the movable contact member 51 against the front panel 20, not shown in FIG. 4, to have the movable contact member 51 move with respect to the stationary contact member 53 toward the switch-off position.

Returning back to FIGS. 2 and 3 of the drawings, the push button 10 includes a pair of horn projections 12 and 13 protruding in opposite directions. Each of the horn projections 12 and 13 has a center axis and frictionally held in the holder portion 21 of the front panel 20, which will be described later. The push button 10 is supported on the front panel 20 with the horn projections 12 and 13 frictionally held in the holder portion 21 of the front panel 20. The push button 10 is adapted to support the movable contact member 51 and pivotable around the center axis of the horn projections 12 and 13 together with the movable contact member 51 in two different directions including a button-pushed direction D1 to have the movable contact member 51 move with respect to the stationary contact member 53 toward the switch-on position and a button-released direction D2 to have the movable contact member 51 move with respect to the stationary contact member 53 toward the switch-off position with the aid of the resilient member 54, not shown in FIGS. 2 and 3.

More specifically, the front panel 20 has a first surface 20*a* outwardly exposed and a second surface 20*b* in face-to-face relationship with the rear panel 60. The front panel 20 is formed with a through bore 25. The rear panel 60 may have a printed circuit board mounted thereon. The through bore 25 has an outer open end flush with the first surface 20*a* and an inner open end flush with the second surface 20*b*. The front panel 20 has a protruded end portion 23 protruded along the inner open end of the through bore 25 on the second surface 20*a*. The front panel 20 constitutes a support member according to the present invention.

The push button 10 has a pushed portion 11 and a flange portion 14 extending radially and outwardly of, and integrally formed with the pushed portion 11. As best shown in FIG. 3, the flange portion 14 extends inwardly of the inner open end of the through bore 25. The flange portion 14 has a first flange section 14*a* and a second flange section 14*b* opposing to and spaced apart from the first flange section 14*a* across the pushed portion 11. The first flange section 14*a* is provided with the horn projections 12 and 13. The pushed portion 11 has a center axis extending substantially in perpendicular relationship with the first surface 20*a* of the front panel 20. The pushed portion 11 is received in the through bore 25 of the front panel 20 to be reciprocable along the center axis of the pushed portion 11 together with the movable contact member 51 of the switch device 50. The second flange section 14*b* is designed to support the movable contact member 51 of the switch device 50 to be reciprocable to ensure that the movable contact member 51 is brought into and out of contact with the stationary contact member 53 of the switch device 50.

The push button 10 is supported by the front panel 20 with the horn projections 12 and 13 frictionally held in the holder portion 21. The push button 10 is pivotable around the center axis of the horn projections 12 and 13 in two different directions including a button-pushed direction D1 to have the second flange section 14*b* move the movable contact member 51 with respect to the stationary contact member 53 toward the switch-on position and a button-released direction D2 to have the movable contact member 510 move with respect to the stationary contact member 53 toward the switch-off position.

The following description will be now directed to how each of the horn projections 12 and 13 is frictionally held in the holder portion 21 in detail with reference to FIG. 1.

Each of the horn projections 12 and 13 is in the form of a circular cross-section shape and has a diameter. Each of the horn projections 12 and 13 extends substantially along the center axis. As will be seen from the above, there has been described only one holder portion 21 for the purpose of simplifying the description and assisting in understanding about the whole constitution of the switching apparatus according to the present invention. In reality, the front panel 20 has a pair of holder portions substantially identical in construction with each other, and the horn projections are frictionally held in the holder portions respectively. The pair of holder portions are simply represented by the holder portion 21 for avoiding tedious repetition. Furthermore, each of the horn projections 12 and 13 is simply represented by the horn projection 12 in the drawings for avoiding tedious repetition because of the fact that the horn projections 12 and 13 are substantially identical in construction with each other. The horn projection constitutes a rotation shaft according to the present invention. The holder portion 21 has a first plate 21*a*, a second plate 21*b*, and a bottom plate 21*c*. The bottom plate 21*c* is fixedly supported on the front panel 20, not shown in FIG. 1. The first plate 21*a* and the second plate 21*b* are opposing to and spaced apart from each other across the bottom plate 21*c*. The first plate 21*a* and the second plate 21*b* are fixedly supported on the bottom plate 21*c*. The first plate 21*a*, the second plate 21*b*, and the bottom plate 21*c* collectively define a groove 22. The front panel 20 further includes a cover plate 30 securely mounted on the/holder portion 21 to define a closed space 22 having each of the horn projections 12 and 13 received therein. In reality, the front panel 20 has a pair of cover plates securely mounted on the respective holder portions to define a pair of closed spaces having the respective horn projections 12 and 13 received therein. The pair of cover plates are simply represented by the cover plate 30 for avoiding tedious repetition because of the fact that the cover plates are substantially identical in construction with each other.

The cover plate 30 of the front panel 20 and the bottom plate 21*c* of the holder portion 21 respectively have inner surfaces 30*a* and 21*f*. The inner surface 30*a* of the cover plate 30 of the front panel 20 and the inner surface 21*f* of the bottom plate 21*c* of the holder portion 21 are opposing to and spaced apart from each other at a distance therebetween. The distance between the inner surface 30*a* of the cover plate 30 of the front panel 20 and the inner surface 21*f* of the bottom plate 21*c* of the holder portion 21 is equal to or less than the diameter of each of the horn projections 12 and 13 to have each of the horn projections 12 and 13 frictionally held in the holder portion 21 of the front panel 20. The inner surfaces 30*a* and 21*f* of the holder portion 21 respectively constitute wall surfaces according to the present invention.

Each of the horn projections 12 and 13 has first and second contact portions respectively held in pressing contact with the inner surface 21*f* of the bottom plate 21*c* of the holder portion 21 and the inner surface 30*a* of the cover plate 30 of the front panel 20. Each of the horn projections 12 and 13 has a center plane passing through the diameter of each of the horn projections 12 and 13 and perpendicular to the bottom plate 21*c* of the holder portion 21. The first and second contact portions of each of the horn projections 12 and 13 are on the center plane and spaced apart from and in parallel relationship with each other. As best shown in FIG. 1, each of the horn projections 12 and 13 is elastically deformable along the center plane and the cover plate 30 of the front panel 20 is elastically deformable with respect to the center plane of each of the horn projections 12 and 13 to have each of the horn projections 12 and 13 frictionally held in the holder portion 21 of the front panel 20. For the purpose of assisting in understanding, the deformations of the horn projection 12 and the cover plate 30 are illustrated in an exaggerated manner in FIG. 1 as being larger than the real deformations of the horn projection 12 and the cover plate 30. The cover plate 30 of the front panel 20 constitutes a deformable wall section according to the present invention.

The first plate 21*a* and the second plate 21*b* of the holder portion 21 have respective inner surfaces 21*d* and 21*e*. The inner surfaces 21*d* and 21*e* of the first plate 21*a* and the second plate 21*b* of the holder portion 21 are opposing to and spaced apart from each other at a distance therebetween. The distance of the inner surfaces 21*d* and 21*e* of the first plate 21*a* and the second plate 21*b* of the holder portion 21 is equal to or greater than the diameter of each of the horn projections 12 and 13. Each of the inner surface 21*f* of the bottom plate 21*c* of the holder portion 21 and the inner surface 30*a* of the cover plate 30 of the front panel 20 exerts a frictional force on the first and second contact portions of each of the horn projections 12 and 13 so that the push button 10 is prevented from colliding against the protruded end portion 23 of the front panel 20 immediately after the movable contact member 51 is moved by the resilient member 54 to the switch-off position. Preferably, the first plate 21*a* and the second plate 21*b* of the holder portion 21 should be elastically deformable to have each of the horn projections 12 and 13 frictionally held in the holder portion 21 of the front panel 20. This means that each of the horn projections 12 and 13 elastically deformed elliptically along the center plane can have third and fourth contact portions respectively held in pressing contact with the inner surfaces 21*d* and 21*e* of the first plate 21*a* and the second plate 21*b* with the result that each of the horn projections 12 and 13 is frictionally held in the holder portion 21 of the front panel 20. In this case, each of the inner surfaces 21*d* and 21*e* of the first plate 21*a* and the second plate 21*b* of the holder portion 21 can exert an additional frictional force on the third and fourth contact portions of each of the horn projections 12 and 13 so that the push button 10 is prevented from colliding against the front panel 20 immediately after the movable contact member 51 is moved by the resilient member 54 to the switch-off position.

The fact that each of the horn projections 12 and 13 is frictionally held in the holder portion 21 of the front panel 20 leads to the fact that the push button 10 and the front panel 20 are prevented from being resonantly oscillated in high and/or middle frequency ranges in the event that the push button 10 should collide against the front panel 20, thereby reducing unpleasant noises to operators' ears.

The following description will be directed to how each of the horn projections 12 and 13 is received in the holder portion 21 of the front panel 20 forming part of the first embodiment of the switching apparatus 1 according to the present invention with reference to FIG. 1.

Firstly, each of the horn projections 12 and 13 is received in the groove 22 of the holder portion 21. Secondly, the cover plate 30 is securely mounted on the holder portion 21 to have each of the horn projections 12 and 13 frictionally held in the holder portion 21.

The operation of the first embodiment of the switching apparatus 1 according to the present invention will be described hereinlater with reference to FIGS. 1 and 3.

When the push button 10 is pressed by an operator, the push button 10 is operated to pivot around the center axis of the horn projection 12 in the button-pushed direction D1 to have the movable contact member 51 move with respect to the stationary contact member 53 toward the switch-on position. The movable contact member 51 is brought in contact with the stationary contact member 53 to establish electrical connection between the movable contact member 51 and the stationary contact member 53.

When, on the other hand, the push button 10 is released by the operator, the resilient member 54 is operated to resiliently urge the movable contact member 51 to have the movable contact member 51 move with respect to the stationary contact member 53 toward the switch-off position. The push button 10 is operated to pivot around the center axis of the horn projection 12 in the button-released direction D2 to have the movable contact member 51 move with respect to the stationary contact member 53 toward the switch-off position. The movable contact member 51 is brought out of contact with the stationary contact member 53 to establish electrical disconnection between the movable contact member 51 and the stationary contact member 53. Each of the inner surface 21*f* of the bottom plate 21*c* of the holder portion 21 and the inner surface 30*a* of the cover plate 30 of the front panel 20 exerts a frictional force on the first and second contact portions of each of the horn projections 12 and 13 so that the push button 10 is prevented from colliding against the front panel 20 immediately after the movable contact member 51 is moved by the resilient member 54 to the switch-off position. Furthermore, each of the horn projections 12 and 13 is frictionally held in the holder portion 21 of the front panel 20 so that the push button 10 and the front panel 20 are prevented from being resonantly oscillated in high and/or middle frequency ranges in the event that the push button 10 collides against the front panel 20, thereby reducing unpleasant noises to operators' ears.

As will be seen from the above detailed description, it is to be understood that the present embodiment of the switching apparatus 1 according to the present invention, comprising: a rear panel 60; a front panel 20 fixedly connected with the rear panel 60 and having a holder portion 21; a switch device 50 including a stationary contact member 53 fixedly mounted on the rear panel 60, and a movable contact member 51 movable with respect to the stationary contact member 53 to assume two different positions including a switch-on position where the movable contact member 51 is brought in contact with the stationary contact member 53 to establish electrical connection between the movable contact member 51 and the stationary contact member 53 and a switch-off position where the movable contact member 51 is brought out of contact with the stationary contact member 53 to establish electrical disconnection between the movable contact member 51 and the stationary contact member 53; and a push button 10 including a pair of horn projections 12 and 13 protruding in opposite directions and each having a center axis, the push button 10 being supported on the front panel 20 with the horn projections 12 and 13 frictionally held in the holder portion 21 of the front panel 20, the push button 10 adapted to support the movable contact member 51 and pivotable around the center axis of the horn projections 12 and 13 together with the movable contact member 51 in two different directions including a button-pushed direction D1 to have the movable contact member 51 move with respect to the stationary contact member 53 toward the switch-on position and a button-released direction D2 to have the movable contact member 51 move with respect to the stationary contact member 53 toward the switch-off position, can prevent the push button 10 from colliding against the front panel 20 immediately after the movable contact member 51 is moved by the resilient member 54 to the switch-off position. Furthermore, the present embodiment of the switching apparatus 1 according to the present invention, can prevent the push button 10 and the front panel 20 from being resonantly oscillated in high and/or middle frequency ranges in the event that the push button 10 collides against the front panel 20, thereby reducing unpleasant noises to operators' ears. Furthermore, the present embodiment of the switching apparatus 1 according to the present invention can eliminate the need of any sound absorption material used for the push button 10 or the front panel 20 to absorb the unpleasant noises. This leads to the fact that the present embodiment of the switching apparatus 1 according to the present invention is simple in construction and noiseless in operation.

Although there has been described in the above about the switching apparatus 1 according to the present invention that each of the horn projections 12 and 13 is in the form of a circular cross-section shape, each of the horn projections 12 and 13 may be in the form of an elliptical cross-section shape as long as each of the horn projections 12 and 13 can be frictionally held in the holder portion 21.

Although there has been described in the above about the first embodiment of the switching apparatus according to the present invention, the present embodiment may be replaced by the second to fourth embodiments of the switching apparatus according to the present invention in order to attain the objects of the present invention. The second to fourth embodiments of the switching apparatus will then be described hereinafter.

Figure 5:
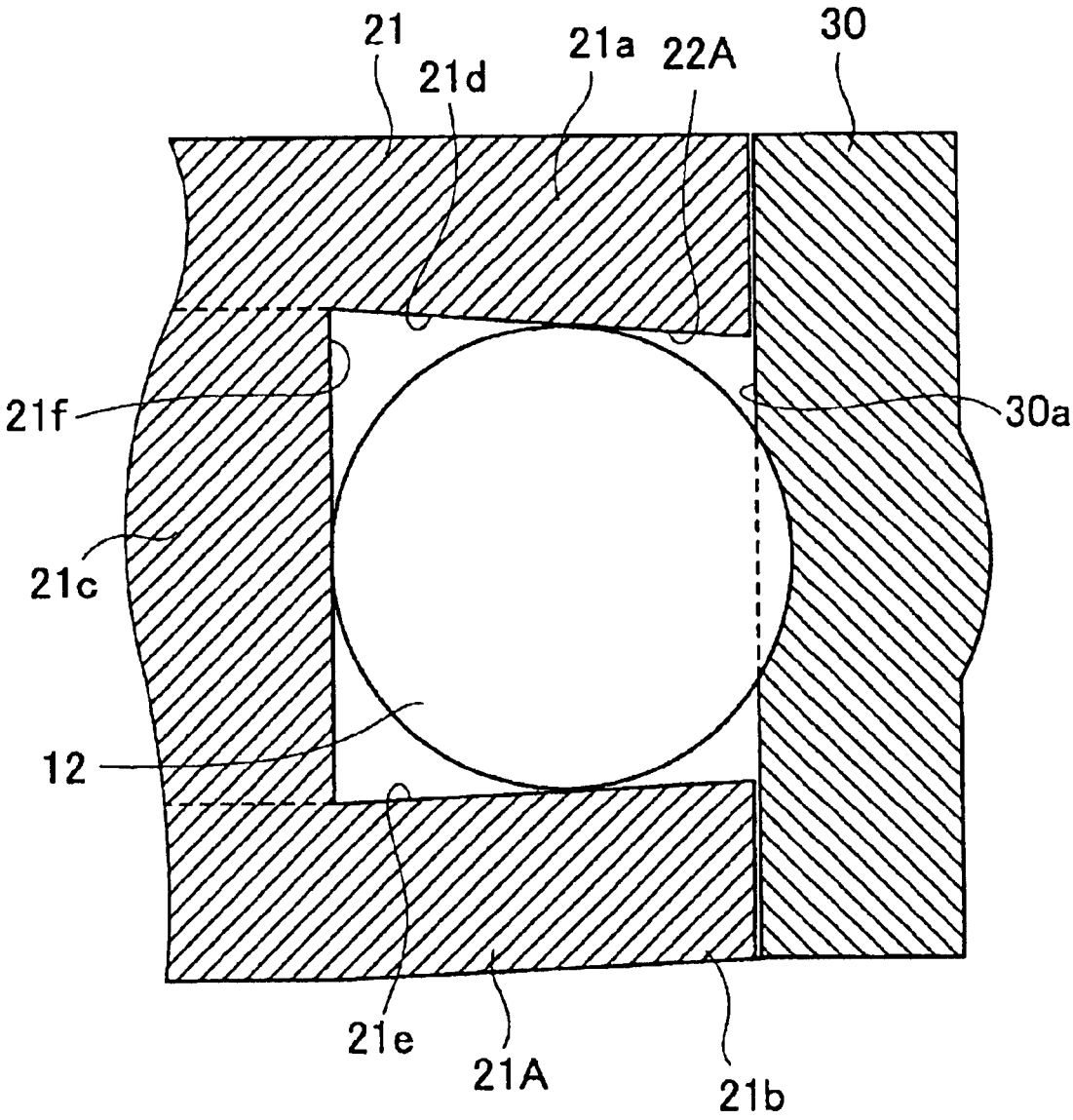
FIG. 5 is an enlarged fragmentary cross-sectional view of a horn projection frictionally held in a holder portion forming part of a second embodiment of the switching apparatus according to the present invention.
Figure 6:
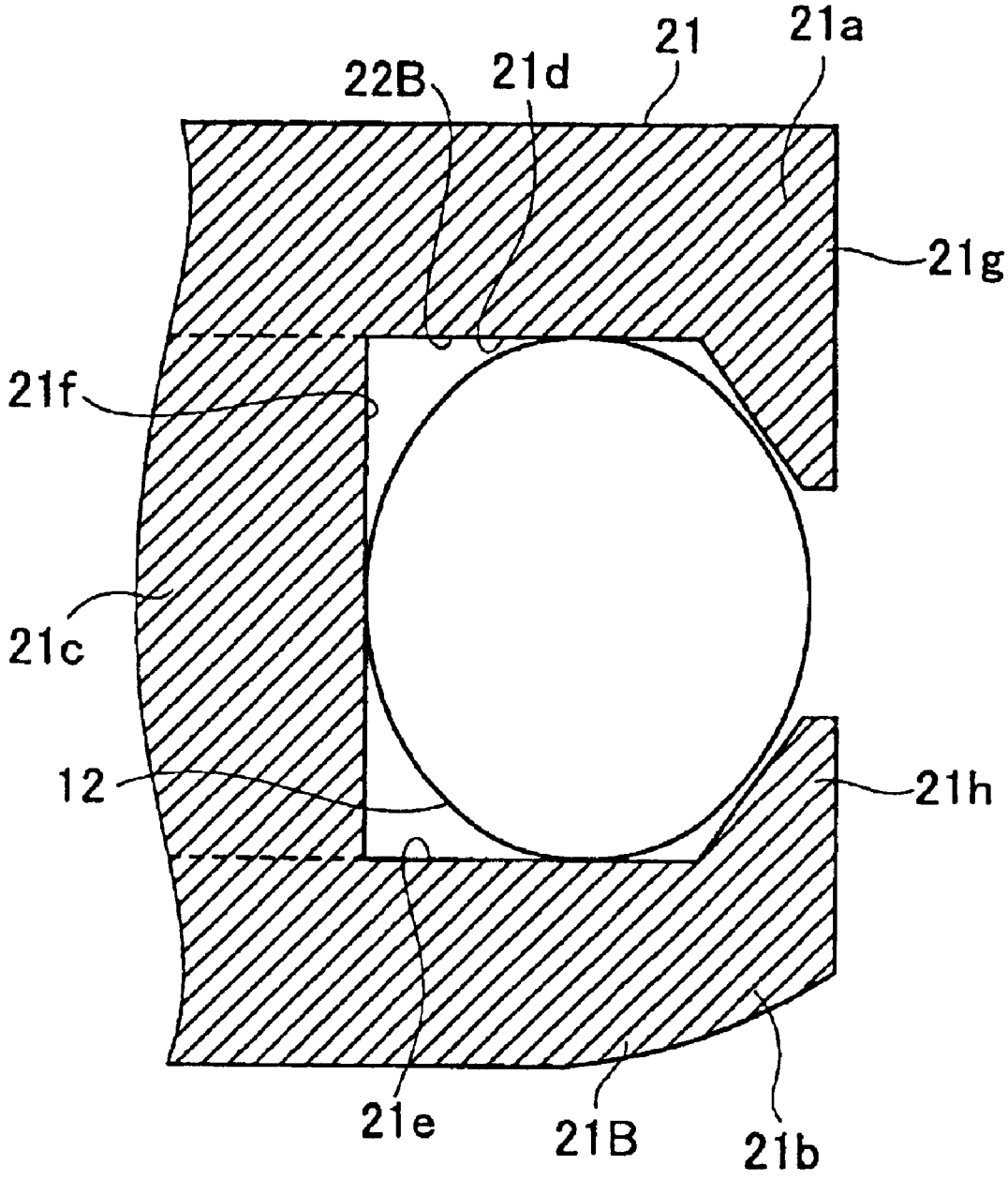
FIG. 6 is an enlarged fragmentary cross-sectional view of a horn projection frictionally held in a holder portion forming part of a third embodiment of the switching apparatus according to the present invention.
Figure 7:
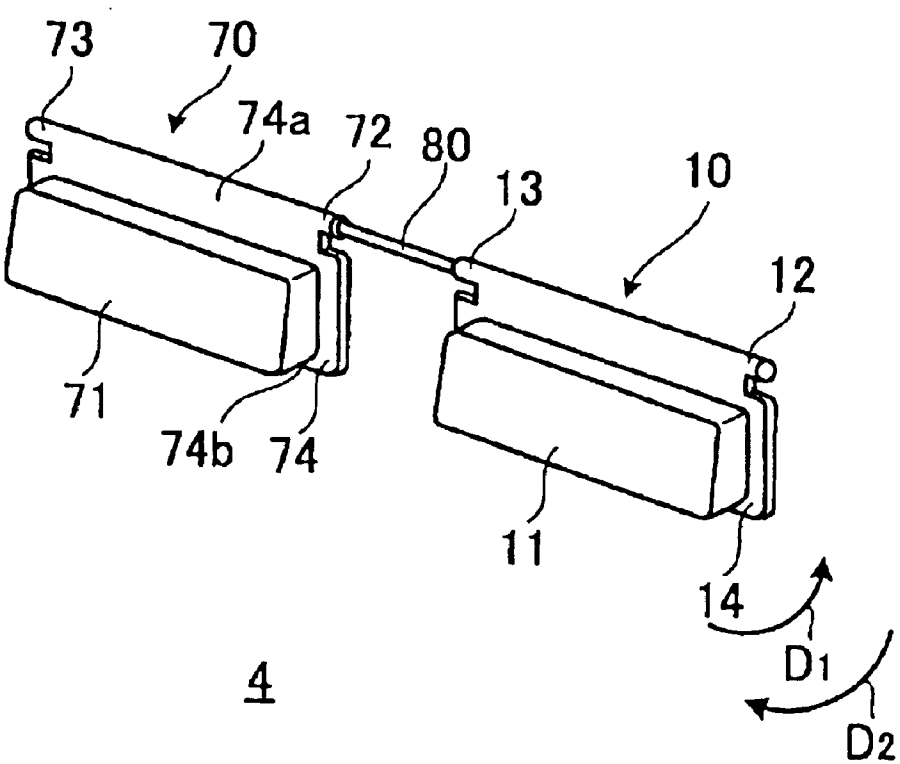
FIG. 7 is a perspective view of a pair of push buttons forming part of a fourth embodiment of the switching apparatus according to the present invention.
Figure 8:
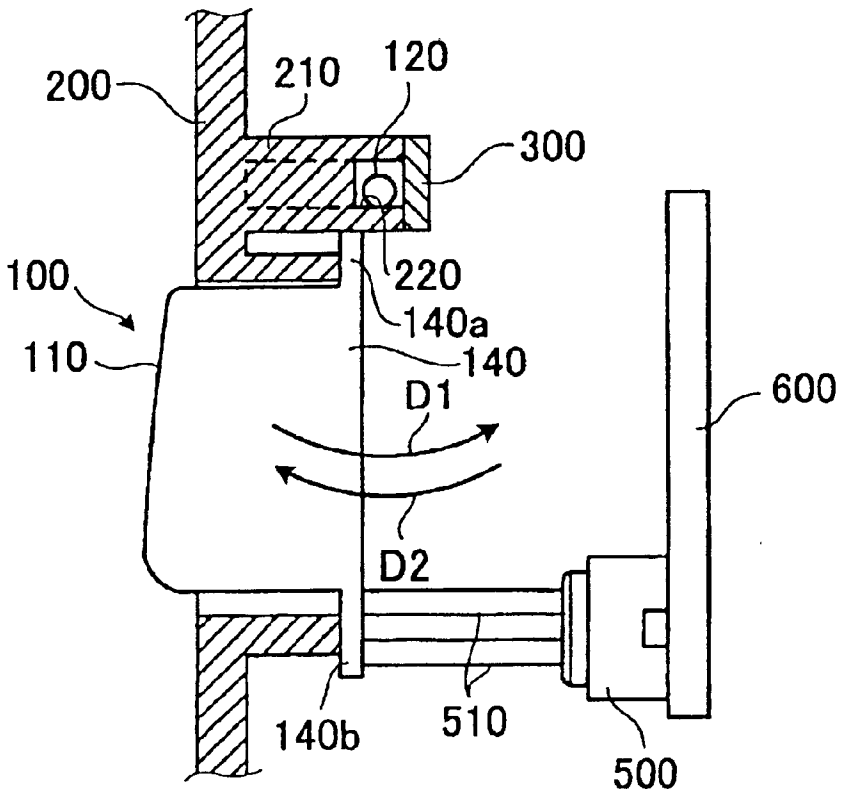
FIG.8 PRIOR ART
FIG. 8 is a fragmentary cross-sectional side view of the conventional switching apparatus according to the present invention.

Referring then to FIGS. 5 to 6, there are shown enlarged fragmentary cross-sectional views of the horn projection frictionally held in the holder portion forming part of the switching apparatus according to the present invention. The constitutional elements of the second to fourth embodiments of the switching apparatus according to the present invention as shown in FIG. 5 to 7 are entirely the same as those of the first embodiment of the switching apparatus according to the present invention as shown in FIGS. 1 to 4 except for the constitutional elements in the following description. Therefore, only the constitutional elements of the second to fourth embodiments of the switching apparatus different from those of the first embodiment of the switching apparatus will be described in detail hereinlater. The constitutional elements of the second to fourth embodiments of the switching apparatus entirely the same as those of the first embodiment of the switching apparatus will not be described but bear the same reference numerals and legends as those of the first embodiment of the switching apparatus in FIGS. 1 to 4 to avoid tedious repetition.

The following description will be directed to the constitutional elements of the second embodiment of the switching apparatus 2 different from those of the first embodiment of the switching apparatus 1. The second embodiment of the switching apparatus 2 according to the present invention comprises a rear panel 60, a switch device 50, and a push button 10, all of which are the same in construction as the switching apparatus 1 according to the present invention and thus their constructions will not be described hereinlater. The front panel 20 forming part of the second embodiment of the switching apparatus 2 has a holder portion 21A in place of the holder portion 21 of the switching apparatus 1.

As best shown in FIG. 5, the first plate 21*a* and the second plate 21*b* of the holder portion 21A have respective inner surfaces 21*d* and 21*e* opposing to and spaced apart from each other at a distance therebetween. The distance of the inner surfaces 21*d* and 21*e* of the first and second plates 21*a* and 21*b* of the holder portion 21A is gradually tapered toward the cover plate 30 in such a manner that the distance close to the cover plate 30 is smaller than the distance remote from the cover plate 30. For the purpose of assisting in understanding, the deformations of the horn projection 12 and the cover plate 30 and the tapered distance of the inner surfaces 21*d* and 21*e* of the first and second plates 21*a* and 21*b* are illustrated in an exaggerated manner in FIG. 5 as being larger than the real deformations of the horn projection 12 and the cover plate 30 and the real tapered distance of the inner surfaces 21*d* and 21*e* of the first and second plates 21*a* and 21*b*.

The first plate 21*a*, the second plate 21*b*, and the bottom plate 21*c* collectively define a groove 22A. The cover plate 30 is securely mounted on the bolder portion 21A to define a closed space 22A having each of the horn projections 12 and 13 received therein. The closed space 22A is in the form of a trapezoidal cross-section shape. The distance between the inner surface 30*a* of the cover plate 30 of the front panel 20 and the inner surface 21*f* of the bottom plate 21*c* of the holder portion 21A is equal to or less than the diameter of each of the horn projections 12 and 13 to have each of the horn projections 12 and 13 frictionally held in the holder portion 21A of the front panel 20. The distance of the inner surfaces 21*d* and 21*e* of the first and second plates 21*a* and 21*b* of the holder portion 21A at the cover plate 30 is equal to or less than the diameter of each of the horn projections 12 and 13 to have each of the horn projections 12 and 13 frictionally held in the holder portion 21A of the front panel 20. At least one of the first plate 21*a* and the second plate 21*b* of the holder portion 21A is elastically deformable with respect to the bottom plate 21*c* to have each of the horn projections 12 and 13 received in the holder portion 21A of the front panel 20.

The following description will be directed to how each of the horn projections 12 and 13 is received in the holder portion 21A of the front panel 20 forming part of the second embodiment of the switching apparatus 2 according to the present invention.

Firstly, the first plate 21*a* and the second plate 21*b* of the holder portion 21A are elastically deformed with respect to the bottom plate 21*c* with the result that the distance of the inner surfaces 21*d* and 21*e* of the first and second plates 21*a* and 21*b* of the holder portion 21A remotest from the bottom plate 21*c* is equal to or greater than the diameter of each of the horn projections 12 and 13. Secondly, each of the horn projections 12 and 13 is received in the groove 22A of the holder portion 21A. The first plate 21*a* and the second plate 21*b* of the holder portion 21A are then naturally elastically restored with respect to the bottom plate 21*c* with the result that the distance of the inner surfaces 21*d* and 21*e* of the first and second plates 21*a* and 21*b* of the holder portion 21A remotest from the bottom plate 21*c* is equal to or less than the diameter of each of the horn projections 12 and 13. Thirdly, the cover plate 30 is securely mounted on the holder portion 21A to have each of the horn projections 12 and 13 frictionally held in the holder portion 21A. As best shown in FIG. 5, the cover plate 30 of the front panel 20 is elastically deformed with respect to the center plane of each of the horn projections 12 and 13 and each of the horn projections 12 and 13 is frictionally held in the holder portion 21A of the front panel 20. As will be seen from the foregoing description, it is to be understood that the present embodiment of the switching apparatus 2 according to the present invention, in which the distance of the inner surfaces 21*d* and 21*e* of the first and second plates 21*a* and 21*b* of the holder portion 21A is gradually tapered toward the cover plate 30 in such a manner that the distance close to the cover plate 30 is smaller than the distance remote from the cover plate 30, makes it difficult for each of the horn projections 12 and 13 to come off the holder portion 21A before the cover plate 30 is securely mounted on the holder portion 21A.

The following description will be now directed to how each of the horn projections 12 and 13 is frictionally held in the holder portion 21A in detail with reference to FIG. 5.

Each of the horn projections 12 and 13 has first and second contact portions respectively held in pressing contact with the inner surface 21*f* of the bottom plate 21*c* of the holder portion 21A and the inner surface 30*a* of the cover plate 30 of the front panel 20. Each of the horn projections 12 and 13 has a center plane passing through the diameter of each of the horn projections 12 and 13 and perpendicular to the bottom plate 21*c* of the holder portion 21A. The first and second contact portions of each of the horn projections 12 and 13 are on the center plane and spaced apart from and in parallel relationship with each other. The present embodiment of the switching apparatus 2 according to the present invention, in which each of the inner surface 21*f* of the bottom plate 21*c* of the holder portion 21 and the inner surface 30*a* of the cover plate 30 of the front panel 20 exerts a frictional force on the first and second contact portions of each of the horn projections 12 and 13 so that the push button 10 is prevented from colliding against the protruded end portion 23 of the front panel 20 immediately after the movable contact member 51 is moved by the resilient member 54 to the switch-off position. Furthermore, each of the horn projections 12 and 13 is frictionally held in the holder portion 21A of the front panel 20 so that the push button 10 and the front panel 20 are prevented from being resonantly oscillated in high and/or middle frequency ranges in the event that the push button 10 collides against the front panel 20, thereby reducing unpleasant noises to operators' ears.

Preferably, the first plate 21*a* and the second plate 21*b* of the holder portion 21 should be elastically deformable to have each of the horn projections 12 and 13 frictionally held in the holder portion 21 of the front panel 20. This means that each of the horn projections 12 and 13 elastically deformed elliptically along the center plane can have third and fourth contact portions respectively held in pressing contact with the inner surfaces 21*d* and 21*e* of the first plate 21*a* and the second plate 21*b* with the result that each of the horn projections 12 and 13 is frictionally held in the holder portion 21 of the front panel 20. In this case, each of the inner surfaces 21*d* and 21*e* of the first plate 21*a* and the second plate 21*b* of the holder portion 21 can exert an additional frictional force on the third and fourth contact portions of each of the horn projections 12 and 13 so that the push button 10 is prevented from colliding against the front panel 20 immediately after the movable contact member 51 is moved by the resilient member 54 to the switch-off position.

As will be seen from the above detailed description, it is to be understood that the present embodiment of the switching apparatus 2 according to the present invention, in which the first plate 21*a* and the second plate 21*b* of the holder portion 21A have respective inner surfaces 21*d* and 21*e* opposing to and spaced apart from each other at a distance therebetween, and the distance of the inner surfaces 21*d* and 21*e* of the first and second plates 21*a* and 21*b* of the holder portion 21A is gradually tapered toward the cover plate 30 in such a manner that the distance close to the cover plate 30 is smaller than the distance remote from the cover plate 30, can prevent the push button 10 from colliding against the front panel 20 immediately after the movable contact member 51 is moved by the resilient member 54 to the switch-off position. Furthermore, the present embodiment of the switching apparatus 2 according to the present invention, can prevent the push button 10 and the front panel 20 from being resonantly oscillated in high and/or middle frequency ranges in the event that the push button 10 collides against the front panel 20, thereby reducing unpleasant noises to operators' ears. Furthermore, the present embodiment of the switching apparatus 2 according to the present invention can eliminate the need of any sound absorption material used for the push button 10 or the front panel 20 to absorb the unpleasant noises. This leads to the fact that the present embodiment of the switching apparatus 2 according to the present invention is simple in construction and noiseless in operation.

The following description will be directed to the constitutional elements of the third embodiment of the switching apparatus 3 different from those of the first embodiment of the switching apparatus 1. The third embodiment of the switching apparatus 3 according to the present invention comprises a rear panel 60, a switch device 50, and a push button 10, all of which are the same in construction as the switching apparatus 1 according to the present invention and thus their constructions will not be described hereinlater. The front panel 20 forming part of the third embodiment of the switching apparatus 3 has a holder portion 21B in place of the bolder portion 21 of the switching apparatus 1.

As best shown in FIG. 6, the first plate 21*a* and the second plate 21*b* of the holder portion 21B respectively have first ends fixedly supported on the bottom plate 21*c* and second ends integrally formed with respective ledges 21*g* and 21*h* inwardly projected toward each other with respect to the bottom plate 21*c*. The ledge 21*g* of the first plate 21*a* and the ledge 21*h* of the second plate 21*b* have respective inner surfaces opposing to and spaced apart from each other at a distance therebetween. The distance of the inner surfaces of the ledges 21*g* and 21*h* is gradually tapered in such a manner that the distance remote from the bottom plate 21*c* is smaller than the distance close to the bottom plate 21*c*. The inner surfaces of the ledges 21*g* and 21*h* remotest from the bottom plate 21*c* are opposing to and spaced apart from the bottom plate 21*c* at a distance equal to or less than the diameter of each of the horn projections. For the purpose of assisting in understanding, the deformation of the horn projection 12 and the tapered distance of the inner surfaces of the ledges 21*g* and 21*h* are illustrated in an exaggerated manner in FIG. 6 as being larger than the real deformation of the horn projection 12 and the real tapered distance of the inner surfaces of the ledges 21*g* and 21*h*.

The distance of the inner surfaces of the ledges 21*g* and 21*h* remotest from the bottom plate 21*c* is equal to or less than the diameter of each of the horn projections 12 and 13 to have each of the horn projections 12 and 13 frictionally held in the holder portion 21B of the front panel 20. At least one of the ledges 21*g* and 21*h* of the first plate 21*a* and the second plate 21*b* is elastically deformable with respect to the bottom plate 21*c* to have each of the horn projections 12 and 13 received in the holder portion 21B of the front panel 20.

The following description will be directed to how each of the horn projections 12 and 13 is received in the holder portion 21B of the front panel 20 forming part of the third embodiment of the switching apparatus 3 according to the present invention.

Firstly, the ledges 21*g* and 21*h* of the first plate 21*a* and the second plate 21*b* are elastically deformed with respect to the bottom plate 21*c* with the result that the distance of the inner surfaces of the ledges 21*g* and 21*h* remotest from the bottom plate 21*c* is equal to or greater than the diameter of each of the horn projections 12 and 13 to have each of the horn projections 12 and 13 frictionally received in the holder portion 21B of the front panel 20. Secondly, each of the horn projections 12 and 13 is received in the groove 22B of the holder portion 21B. The ledges 21*g* and 21*h* of the first plate 21*a* and the second plate 21*b* are then naturally elastically restored with respect to the bottom plate 21*c* with the result that the distance of the inner surfaces of the ledges 21*g* and 21*h* remotest from the bottom plate 21*c* is equal to or less than the diameter of each of the horn projections 12 and 13 to have each of the horn projections 12 and 13 frictionally held in the holder portion 21B of the front panel 20.

The following description will be now directed to how each of the horn projections 12 and 13 is frictionally held in the holder portion 21B in detail with reference to FIG. 6.

Each of the horn projections 12 and 13 has contact portions respectively held in pressing contact with the inner surface 21*f* of the bottom plate 21*c*, the inner surfaces 21*d* and 21*e* of the first plate 21*a* and the second plate 21*b* including the ledges 21*g* and 21*h* with the result that each of the horn projections 12 and 13 is frictionally held in the holder portion 21B of the front panel 20. This means that each of the inner surface 21*f* of the bottom plate 21*c*, the inner surfaces 21*d* and 21*e* of the first plate 21*a* and the second plate 21*b* including the ledges 21*g* and 21*h* of the holder portion 211B exerts a frictional force on the contact portions of each of the horn projections 12 and 13 so that the push button 10 is prevented from colliding against the front panel 20 immediately after the movable contact member 51 is moved by the resilient member 54 to the switch-off position. Furthermore, each of the horn projections 12 and 13 is frictionally held in the holder portion 21B of the front panel 20 so that the push button 10 and the front panel 20 are prevented from being resonantly oscillated in high and/or middle frequency ranges in the event that the push button 10 collides against the front panel 20, thereby reducing unpleasant noises to operators' ears.

As will be seen from the above detailed description, it is to be understood that the present embodiment of the switching apparatus 3 according to the present invention, in which the first plate 21*a* and the second plate 21*b* of the holder portion 21B respectively have first ends fixedly supported on the bottom plate 21*c* and second ends integrally formed with respective ledges 21*g* and 21*h* inwardly projected toward each other with respect to the bottom plate 21*c*, the ledge 21*g* of the first plate 21*a* and the ledge 21*h* of the second plate 21*b* have respective inner surfaces opposing to and spaced apart from each other at a distance therebetween, the distance of the inner surfaces of the ledges 21*g* and 21*h* is gradually tapered in such a manner that the distance remote from the bottom plate 21*c* is smaller than the distance close to the bottom plate 21*c*, and the inner surfaces of the ledges 21*g* and 21*h* remotest from the bottom plate 21*c* are opposing to and spaced apart from the bottom plate 21*c* at a distance equal to or less than the diameter of each of the horn projections, can prevent the push button 10 from colliding against the front panel 20 immediately after the movable contact member 51 is moved by the resilient member 54 to the switch-off position. The present embodiment of the switching apparatus 3 thus constructed eliminates the need of the cover plate 30 to be securely mounted on the holder portion 21B to define a closed space 22B. Furthermore, the present embodiment of the switching apparatus 3 according to the present invention can prevent the push button and the front panel 20 from being resonantly oscillated in high and/or middle frequency ranges in the event that the push button 10 collides against the front panel 20, thereby reducing unpleasant noises to operators' ears. This means that the present embodiment of the switching apparatus 3 can eliminate the need of any sound absorption material used for the push button 10 or the front panel 20. This leads to the fact that the present embodiment of the switching apparatus 3 according to the present invention is simple in construction and noiseless in operation.

The following description will be directed to constituent elements of the fourth embodiment of the switching apparatus 4 different from those of the first embodiment of the switching apparatus 1. The fourth embodiment of the switching apparatus 4 according to the present invention comprises a rear panel 60, a switch device 50, and a push button 10, all of which are the same in construction as the switching apparatus 1 according to the present invention and thus their constructions will be omitted from the description for avoiding tedious repetition. The switching apparatus 4 further comprises at least one subsequent push button, at least one subsequent switch device, and a front panel having at least one additional through bore and at least one subsequent holder portion in place of the front panel 20, which will be described hereinlater.

As best shown in FIG. 7, the fourth embodiment of the switching apparatus 4 further comprises at least one subsequent push button 70 disposed in the vicinity of the push button 10. The subsequent push button 70 includes a pair of horn projections 72 and 73 protruding in opposite directions. Each of the horn projections 72 and 73 has a center axis, and is similar in construction to each of the horn projections 12 and 13 of the first embodiment of the switching apparatus 1. The center axis of each of the horn projections 72 and 73 is common to that of each of the horn projections 12 and 13. The switching apparatus 4 comprises a front panel, not shown in FIG. 7. The front panel of the switching apparatus 4 has a holder portion and a through bore, not shown in FIG. 7, the same in construction as those of the previous embodiments. The front panel of the switching apparatus 4 further has a subsequent holder portion, not shown in FIG. 7. The subsequent holder portion is similar in construction to the holder portion 21 of the first embodiment of the switching apparatus 1. The switching apparatus 4 further comprises at least one subsequent switch device, not shown in FIG. 7. The subsequent switch device is similar in construction to the switch device 50 of the first embodiment of the switching apparatus 1 and comprising a stationary contact member, fixedly mounted on the rear panel, not shown in FIG. 7, and a movable contact member movable with respect to the stationary contact member between the switch-on position and the switch-off position. The subsequent switch device further has a resilient member, not shown in FIG. 7, for resiliently urging the movable contact member against the front panel to have the movable contact member move with respect to the stationary contact member toward the switch-off position.

The subsequent push button 70 is supported on the front panel with the horn projections 72 and 73 frictionally held in the subsequent holder portion of the front panel and pivotable around the center axis of the horn projections 72 and 73 together with the movable contact member of the subsequent switch device in two different directions including a button-pushed direction D1 to have the movable contact member move with respect to the stationary contact member of the subsequent switch device toward a switch-on position and a button-released direction D2 to have the movable contact member move with respect to the stationary contact member of the subsequent switch device toward a switch-off position. The switching apparatus 4 further comprises a connecting member 80 for connecting one of the horn projections 72 and 73 of the subsequent push button 70 with one of the horn projections 12 and 13 of the push button 10.

More specifically, the front panel has at least one additional through bore, not shown in FIG. 7. The additional through bore is similar in construction to the through bore 25 of the switching apparatus 1 and has an outer open end flush with the first surface of the front panel and an inner open end flush with the second surface of the front panel. The subsequent push button 70 has a pushed portion 71 and a flange portion 74 extending radially and outwardly of, and integrally formed with the pushed portion 71. The flange portion 74 extends inwardly of the inner open end of the additional through bore, not shown in FIG. 7. The flange portion 74 has a first flange section 74*a* and a second flange section 74*b* opposing to and spaced apart from the first flange section 74*a* across the pushed portion 71. The first flange section 74*a* is provided with the horn projections 72 and 73. The pushed portion 71 has a center axis extending substantially in perpendicular relationship with the first surface of the front panel. The pushed portion 71 is received in the additional through bore of the front panel to be reciprocable along the center axis of the pushed portion 71 together with the movable contact member of the subsequent switch device. The second flange section 74*b* is designed to support the movable contact member of the subsequent switch device to be reciprocable to ensure that the movable contact member is brought into and out of contact with the stationary contact member of the subsequent switch device.

Furthermore, when the pushed portion 11 of the push button 10 is pressed by an operator and the push button 10 is pivoted around the center axis of the horn projections 12 and 13 in the button-pushed direction D1, the one of the horn projections 12 and 13 connected with the connecting member 80 imparts a torsional force on the connecting member 80. When, on the other hand, the pushed portion 71 of the subsequent push button 70 is pressed by an operator and the subsequent push button 70 is pivoted around the center axis of the horn projections 72 and 73 in the button-pushed direction D1, the one of the horn projections 72 and 73 connected with the connecting member 80 imparts a torsional force on the connecting member 80. The connecting member 80 has a torsional rigidity large enough to withstand the torsional force imparted by the one of the horn projections 12 and 13 when the push button 10 is pressed by an operator and the one of the horn projections 12 and 13 is pivoted around the center axis of the horn projections 12 and 13 in the button-pushed direction D1 so that the torsional force imparted by the one of the born projections 12 and 13 is not transmitted to the one of the horn projections 72 and 73. Similarly, the connecting member 80 has a torsional rigidity large enough to withstand the torsional force imparted by the one of the horn projections 72 and 73 when the subsequent push button 70 is pressed by an operator and the one of the horn projections 72 and 73 is pivoted around the center axis of the horn projections 72 and 73 in the button-pushed direction D1 so that the torsional force imparted by the one of the horn projections 72 and 73 is not transmitted to the one of the horn projections 12 and 13.

This means that present embodiment of the switching apparatus 4 comprises: a support member 20 having a holder portion 21; a plurality of push buttons 10 and 70 each having a rotation shaft rotatably and tightly supported on the holder portion 21 of the support member 20; the push buttons 10, 70 being connected with a connected member 80 made of a resilient material to ensure that when one of the push buttons 10, 70 is operated, the others of the push buttons 10, 70 is prevented from being operated wherein the support member 20 is constituted by a front panel 20.

Although it has been described in the above that the present embodiment of the switching apparatus comprises one subsequent push button, the present embodiment of the switching apparatus according to the present invention may comprise two or more subsequent push buttons in the same manner as described hereinearlier.

As will be seen from the above detailed description, it is to be understood that the present embodiment of the switching apparatus 4 according to the present invention can comprise a plurality of push buttons and prevent each of the push buttons from colliding against the front panel immediately after the movable contact member is moved by the resilient member to the switch-off position. Furthermore, the present embodiment of the switching apparatus 4 according to the present invention, can prevent each of the push buttons and the front panel from being resonantly oscillated in high and/or middle frequency ranges in the event that each of the push buttons collides against the front panel, thereby reducing unpleasant noises to operators' ears. Furthermore, the preset embodiment of the switching apparatus 4 according to the present invention can eliminate the need of any sound absorption material used for the push buttons or the front panel. This leads to the fact that the present embodiment of the switching apparatus 4 according to the present invention is in construction and noiseless in operation.

Furthermore, the present embodiment of the switching apparatus 4 can be assembled in a simple process in such a manner that the push button 10 and the subsequent push button 70 connected by the connecting member 80 with the push button 10 are respectively inserted into the through bores of the front panel, thereby simplifying the manufacturing process and reducing the manufacturing time.

While it has been described in the previous embodiment that the connecting member 80 can have a torsional rigidity large enough to withstand a torsional force imparted by the one of the horn projections when the one of the horn projections is pivoted around the center axis of the horn projections, the switching apparatus 4 according to the present invention may be constituted by any other means as long as the connecting means 80 does not transmit the torsional force imparted by the one of the horn projections to the other one of the horn projections when the one of the horn projections is pivoted around the center axis of the horn projection. This means that the connecting means 80 may be a connecting rod in the form of, for example, a hollow shape having pivotably received therein one of the horn projections with the result that the connecting rod can have the one of the born projections pivoted around the center axis without imparting the torsional force on the connecting means 80.

Although there has been described in the foregoing embodiments that each of the horn projections is in the form of a circular cross-section shape, each of the horn projections forming part of the switching apparatus according to the present invention may be in the form of, for example, an elliptical cross-section shape as long as each of the horn projections can be frictionally held in the holder portion.

While the subject invention has been described with relation to the embodiments, various modifications and adaptations thereof will now be apparent to those skilled in the art as far as such modifications and adaptations fall within the scope of the appended claims intended to be covered thereby.

What is claimed is:

1. A switching apparatus, comprising: a rear panel; a front panel fixedly connected with said rear panel and having a holder portion; a switch device including a stationary contact member fixedly mounted on said rear panel, and a movable contact member movable with respect to said stationary contact member to assume two different positions including a switch-on position where said movable contact member is brought in contact with said stationary contact member to establish electrical connection between said movable contact member and said stationary contact member and a switch-off position where said movable contact member is brought out of contact with said stationary contact member to establish electrical disconnection between said movable contact member and said stationary contact member; and a push button including a pair of horn projections protruding in opposite directions and each having a center axis, said push button being supported on said front panel with said horn projections frictionally held in said holder portion of said front panel, said push button adapted to support said movable contact member and pivotable around said center axis of said horn projections together with said movable contact member in two different directions including a button-pushed direction to have said movable contact member move with respect to said stationary contact member toward said switch-on position and a button-released direction to have said movable contact member move with respect to said stationary contact member toward said switch-off position.

2. A switching apparatus as set forth in claim 1, in which each of said horn projections is in the form of a circular cross-section shape having a diameter, each of said horn projections extending substantially along said center axis, said holder portion has a bottom plate fixedly supported on said front panel, a first plate and a second plate opposing to and spaced apart from each other across said bottom plate, said first plate and said second plate fixedly supported on said bottom plate, said front panel further includes a cover plate securely mounted on said holder portion to define a closed space having each of said horn projections received therein, said cover plate of said front panel and said bottom plate of said holder portion respectively having inner surfaces, said inner surfaces of said cover plate of said front panel and said bottom plate of said holder portion opposing to and spaced apart from each other at a distance therebetween, and said distance of said inner surfaces of said cover plate of said front panel and said bottom plate of said holder portion is equal to or less than said diameter of each of said horn projections to have each of said horn projections frictionally held in said holder portion of said front panel.

3. A switching apparatus as set forth in claim 2, in which each of said born projections has first and second contact portions respectively held in pressing contact with said inner surfaces of said bottom plate of said holder portion and said cover plate of said front panel, and a center plane passing through said diameter of each of said horn projections and perpendicular to said bottom plate of said holder portion, each of said horn projections is elastically deformable along said center plane, and said first and second contact portions of each of said horn projections are on said center plane, and spaced apart from and in parallel relationship with each other.

4. A switching apparatus as set forth in claim 3, in which said cover plate of said front panel is elastically deformable with respect to said center plane of each of said horn projections to have each of said horn projections frictionally held in said holder portion of said front panel.

5. A switching apparatus as set forth in claim 2, in which said first plate and said second plate of said holder portion have respective inner surfaces, said inner surfaces of said first plate and said second plate of said holder portion opposing to and spaced apart from each other at a distance therebetween, and said distance of said inner surfaces of said first plate and said second plate of said holder portion is equal to or greater than said diameter of each of said horn projections.

6. A switching apparatus as set forth in claim 2, in which said first plate and said second plate of said holder portion have respective inner surfaces opposing to and spaced apart from each other at a distance therebetween, and said distance of said inner surfaces of said first and second plates of said holder portion is gradually tapered toward said cover plate in such a manner that said distance close to said cover plate is smaller than said distance remote from said cover plate.

7. A switching apparatus as set forth in claim 6, in which said distance of said inner surfaces of said first and second plates of said holder portion at said cover plate is equal to or less than said diameter of each of said horn projections to have each of said horn projections frictionally held in said holder portion of said front panel.

8. A switching apparatus as set forth in claim 6, in which at least one of said first plate and said second plate of said holder portion is elastically deformable with respect to said bottom plate to have each of said horn projections received in said holder portion of said front panel.

9. A switching apparatus as set forth in claim 1, in which each of said horn projections is in the form of a circular cross-section shape having a diameter, each of said horn projections extending substantially along said center axis, said holder portion has a bottom plate fixedly supported on said front panel, a first plate and a second plate opposing to and spaced apart from each other across said bottom plate, said first plate and said second plate of said holder portion respectively have first ends fixedly supported on said bottom plate and second ends integrally formed with respective ledges inwardly projected toward each other with respect to said bottom plate, said ledges of said first plate and said second plate have respective inner surfaces opposing to and spaced apart from each other at a distance therebetween, said distance of said inner surfaces of said ledges is gradually tapered in such a manner that said distance remote from said bottom plate is smaller than said distance close to said bottom plate, and said distance of said inner surfaces of said ledges remotest from said bottom plate is less than said diameter of each of said horn projections.

10. A switching apparatus as set forth in claim 9, in which said inner surfaces of said ledges remotest from said bottom plate are opposing to and spaced apart from said bottom plate at a distance equal to or less than said diameter of each of said born projections to have each of said horn projections frictionally held in said holder portion of said front panel.

11. A switching apparatus as set forth in claim 9, in which at least one of said ledges of said first plate and said second plate is elastically deformable with respect to said bottom plate to have each of said horn projections received in said holder portion of said front panel.

12. A switching apparatus as set forth in claim 1, which further comprises: at least one subsequent push button disposed in the vicinity of said push button, said subsequent push button including a pair of horn projections protruding in opposite directions and each having a center axis, said subsequent push button being supported on said front panel with said horn projections frictionally held in said holder portion of said front panel and pivotable around said center axis of said horn projections together with a movable contact member in two different directions including a button-pushed direction to have said movable contact member move with respect to a stationary contact member toward a switch-on position and a button-released direction to have said movable contact member move with respect to said stationary contact member toward a switch-off position; and a connecting member for connecting one of said horn projections of said subsequent push button with one of said horn projections of said push button.

13. A switching apparatus as set forth in claim 12, in which said connecting member has a torsional rigidity large enough to withstand a torsional force imparted by said one of said horn projections when said push button is pivoted around said center axis of said horn projections.

14. A switching apparatus as set forth in claim 12, in which said connecting member is a connecting rod in the form of a hollow shape having pivotably received therein one of said horn projections.

15. A switching apparatus as set forth in claim 1, in which said front panel has formed therein a groove, having each of said horn projections received therein.

16. A switching apparatus as set forth in claim 1, each of said horn projections is in the form of an elliptical cross-section shape.

17. A switching apparatus, comprising: a support member having a holder portion; a push button having a rotation shaft rotatably and tightly supported on said holder portion of said support member, and a switching device operative to perform a switching action with the rotation of said push button.

18. A switching apparatus as set forth in claim 17, in which said holder portion of said support member has a pair of wall surfaces held in frictional contact with said rotation shaft of said push button.

19. A switching apparatus as set forth in claim 18, in which said holder portion of said support member is partly constituted by a deformable wall section to ensure that said holder portion is deformed to tightly hold said rotation shaft.

20. A switching apparatus, comprising: a support member having a holder portion; a plurality of push buttons each having a rotation shaft rotatably and tightly supported on said holder portion of said support member; said push buttons being connected member made of a resilient material to ensure that when one of said push buttons is operated, the others of said push buttons is prevented from being operated.

* * * * *

UNITED STATES PATENT AND TRADEMARK OFFICE

CERTIFICATE OF CORRECTION

PATENT NO. : 6,867,384 B1
DATED : March 15, 2005
INVENTOR(S) : Ichihara et al.

It is certified that error appears in the above-identified patent and that said Letters Patent is hereby corrected as shown below:

Column 20,
Line 54, after "connected" please insert -- with a connected member --.

Signed and Sealed this

Fifth Day of July, 2005

JON W. DUDAS
*Director of the United States Patent and Trademark Office*